US005387125A

United States Patent [19]

Davis et al.

[11] Patent Number: 5,387,125

[45] Date of Patent: Feb. 7, 1995

[54] CONNECTOR FOR FLEXIBLE FLAT CABLE

[75] Inventors: Larry L. Davis, West Linn; Michael L. Demeter, Vernonia, both of Oreg.

[73] Assignee: The Whitaker Corporation, Wilmington, Del.

[21] Appl. No.: 99,029

[22] Filed: Jul. 29, 1993

[51] Int. Cl.[6] ..... H01R 9/07

[52] U.S. Cl. ..... 439/497; 439/578

[58] Field of Search ..... 439/67, 77, 492–499, 439/578, 581

[56] References Cited

U.S. PATENT DOCUMENTS

| | | | |
|---|---|---|---|
| 3,634,806 | 1/1972 | Ferguson | 439/497 |
| 4,051,383 | 9/1977 | Dola | 307/11 |
| 4,054,353 | 10/1977 | Saunders et al. | 339/176 MF |
| 4,474,420 | 10/1984 | Nestor | 339/116 MF |
| 4,579,404 | 4/1986 | Lockard | 439/497 |
| 4,655,515 | 4/1987 | Hamsher, Jr. et al. | 439/497 |
| 4,875,877 | 10/1989 | Fleak et al. | 439/497 |
| 4,973,264 | 11/1990 | Kamono et al. | 439/497 |
| 5,057,650 | 10/1991 | Urushibata et al. | 174/88 R |
| 5,083,939 | 1/1992 | Ittah | 439/496 |
| 5,163,849 | 11/1992 | Fogg et al. | 439/497 |
| 5,267,814 | 12/1993 | Koegel et al. | 439/497 |

*Primary Examiner*—David L. Pirlot

[57] ABSTRACT

An electrical connector (12) comprises, two rows (14) of opposed electrical contacts (13, 16) for clamping a flat cable (5), at least one row (11) of coaxial cables (5) having signal wires (6) connected to signal contacts (13) of one contact row (14), and conductive shields (8) of the cables (5) connected to a ground bus (17), in turn, connected to each available ground contact (16) of the one contact row (14), both rows (14) of contacts (13, 16) being held by insulative holders (24), cover plates (28) over the contacts (13, 16) and the ground bus (17), and a removable ground plate (19) connected to the ground bus (17) by bendable grounding tails (18) extending from the ground bus (17).

9 Claims, 4 Drawing Sheets

CONNECTOR FOR FLEXIBLE FLAT CABLE

FIELD OF THE INVENTION

The invention pertains to an electrical connector for connecting electrical cables to an edge of a flexible flat cable, and particularly, to a connector for connecting a row of coaxial electrical cables to an edge of one flat cable.

BACKGROUND OF THE INVENTION

Flexible flat cable comprises, an electrical cable constructed of slender, electrical conductor traces on broad surfaces of a thin and flexible sheet of dielectric material. The conductor traces are manufactured by a process of metal plating to apply plated metal to the flexible sheet, followed by chemical etching of the plated metal to produce the final shapes of the slender conductor traces. Alternatively, the circuit traces can be fabricated by a selective metal plating process that applies plated metal only where the slender circuit traces are desired. The selective metal plating process will eliminate the need to chemical etch the plated metal. This type of cable provides numerous conductor traces in a small space, and is useful to provide numerous parallel conductor traces connected to high density electronic circuits in an electronic device. The flat cable emanates from the electronic device, and is useful to connect the electronic device to larger electrical cables of electrical equipment.

Multiple flat cables are used for connection to numerous electronic circuits, for example, the electronic circuits in a medical diagnostic transducer. The multiple flat cables are attached at their one ends to the transducer. The flat cables emanate from the transducer in a compact stack, one on another. The edges of the flat cables can be spread out from one another in the stack for connection of them to larger coaxial type, electrical cables that are associated with medical diagnostic equipment. An electrical connector is desired for the coaxial cables that will disconnect from respective flat cables to permit replacement of a defective transducer, and to permit interchange among transducers of different types. Such an electrical connector would be narrow to match the thin and flat configurations of the flat cables, to fit compactly within the stack of multiple flat cables, and to permit close together stacking of multiple connectors within the stack of flat cables. Such a connector is capable of disconnecting from a flat cable, which allows the flat cable to be replaced or interchanged with other flat cables.

A flexible, double sided, flat cable will have circuit traces on both sides. An electrical connector is desired that will connect and disconnect coaxial cables to the circuit traces on both sides of a double sided, flat cable.

SUMMARY OF THE INVENTION

According to an embodiment of the invention, an electrical connector for multiple coaxial cables connects with, and disconnects from, an edge of a flexible flat cable.

According to another embodiment, the invention relates to an electrical connector for coaxial cables, wherein the cables are arranged in two rows for connecting and disconnecting from a double sided, flexible flat cable.

A feature of the invention resides in an electrical connector for multiple coaxial cables in a cable row, and further wherein the connector fits compactly with a flexible, flat cable with which the connector connects and disconnects.

Embodiments of the invention will now be described by way of example with reference to the accompanying drawings, according to which:

DETAILED DESCRIPTION

Figure 1:
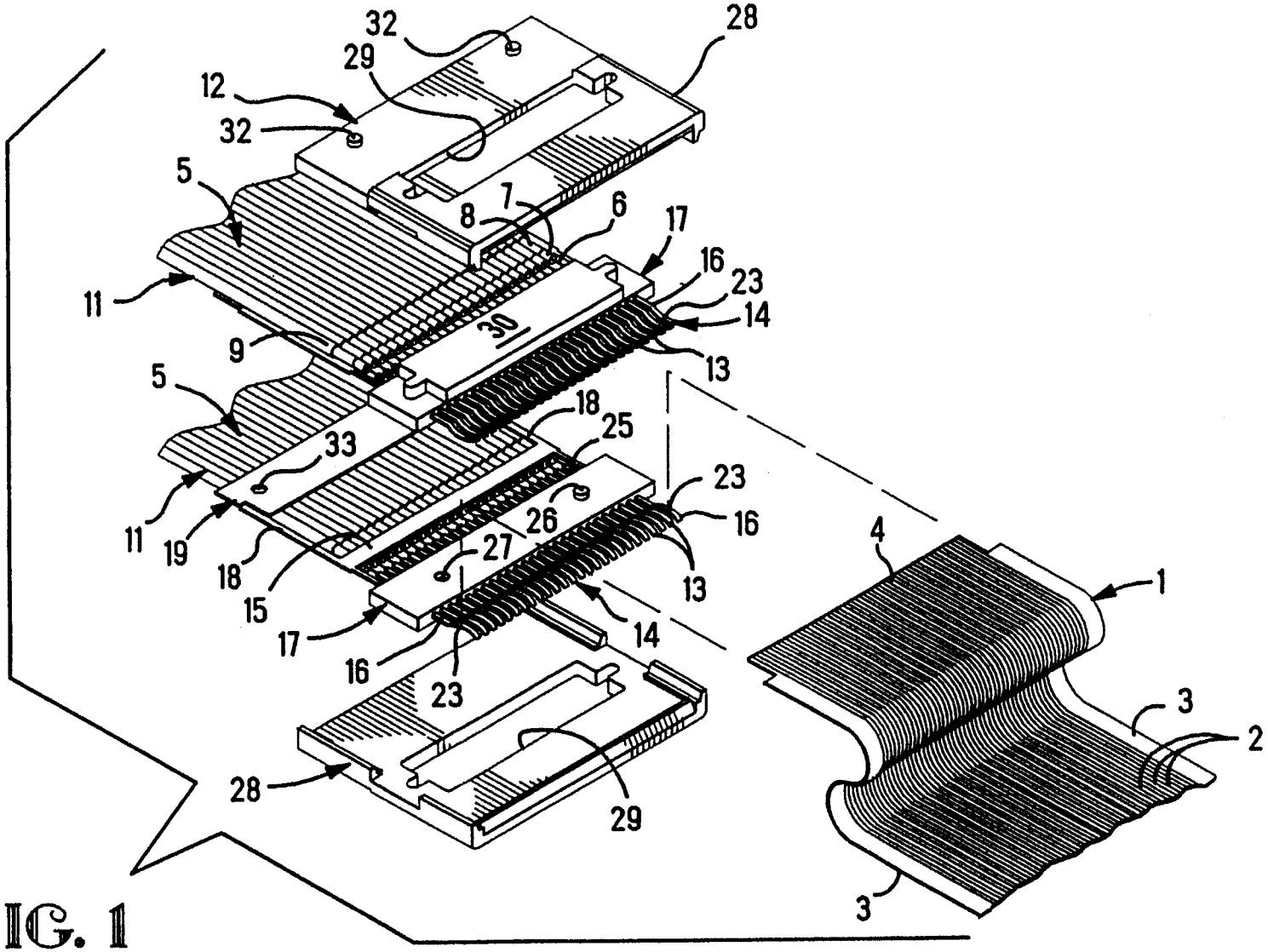
FIG. 1 a perspective view of an electrical connector for multiple coaxial cables for connection with an edge of a .flexible flat cable, with parts separated from one another.

With more particular reference to FIGS. 1, a flexible, flat cable 1 comprises, slender, electrical conductor traces 2 on broad surfaces that are on both sides 3 of a thin and flexible sheet of dielectric material. The flat cable 1 is flexible to allow bending of the conductor traces 2. The flat cable 1 is slender, and permits close compact spacing of many conductor traces 2 in a small volume.

Figure 4:
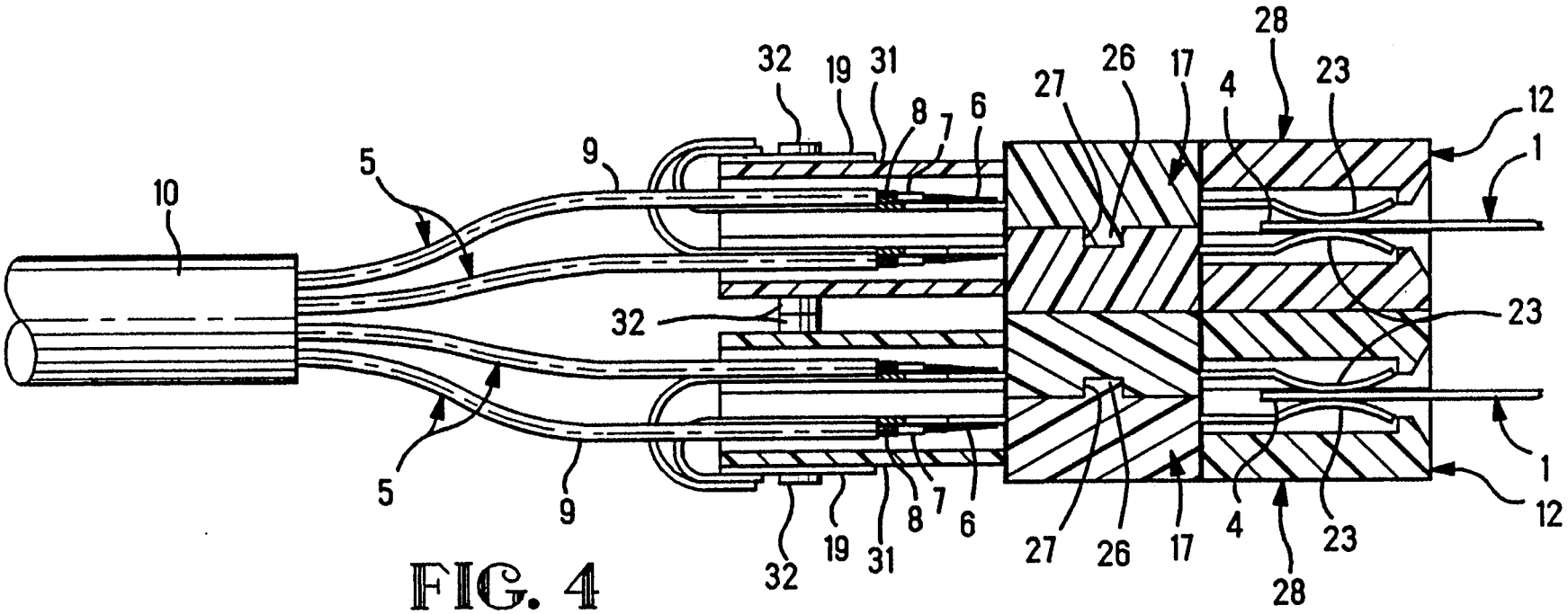
FIG. 4 is an enlarged view in section of the electrical connector shown in FIG. 1 together with another, duplicate connector.

It is common to find multiple flat cables 1 in a compact stack, one on another, for example, shown as being greatly enlarged in FIG. 4. Further, for example, the stack of flat cables 1 is associated with a medical diagnostic transducer, not shown. Edges 4 of the flat cables 1 can be spread out from one another in the stack for connection and disconnection with multiple electrical cables 5, for example coaxial cables.

Figure 2:
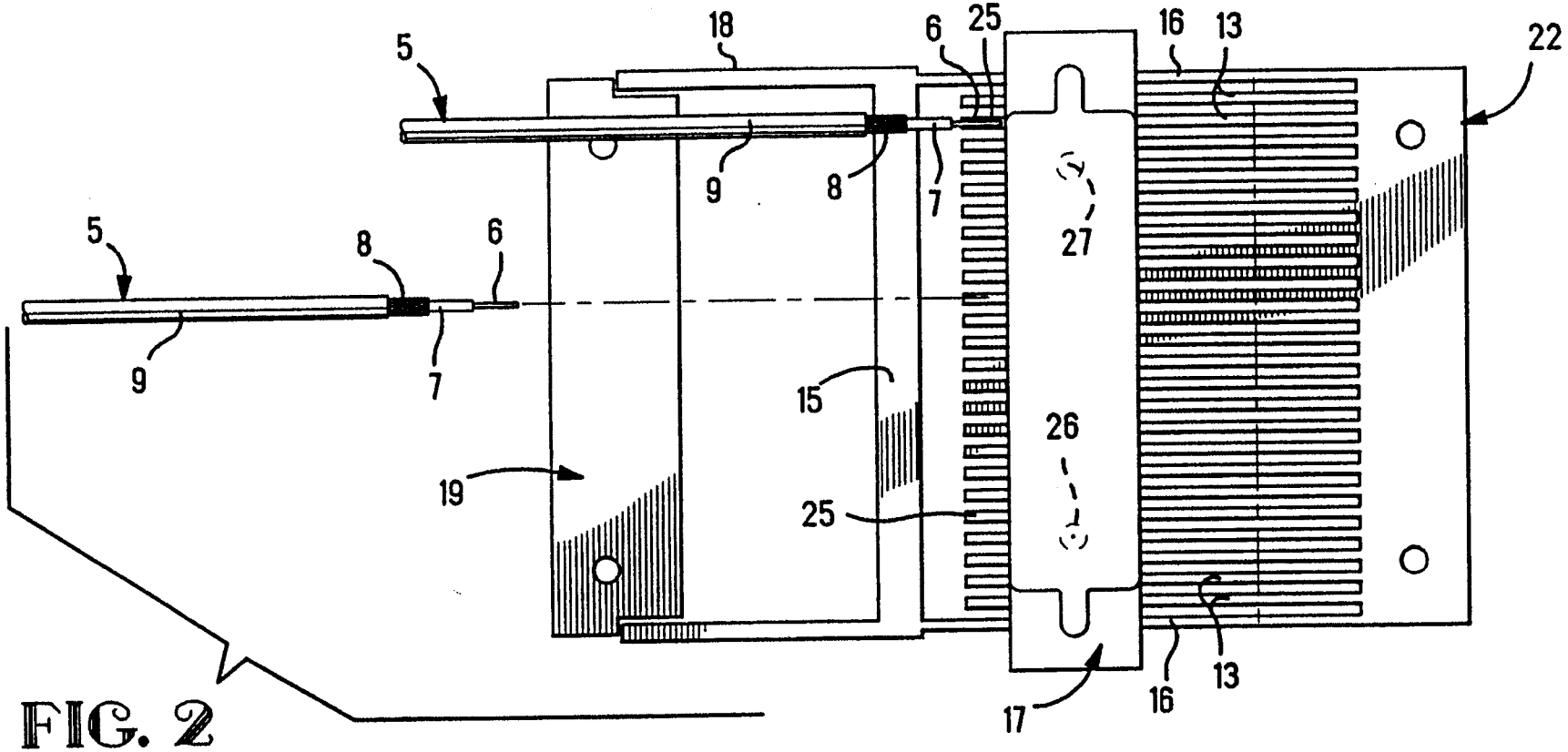
FIG. 2 is a top plan view of a portion of the connector shown in FIG. 1.
Figure 3:
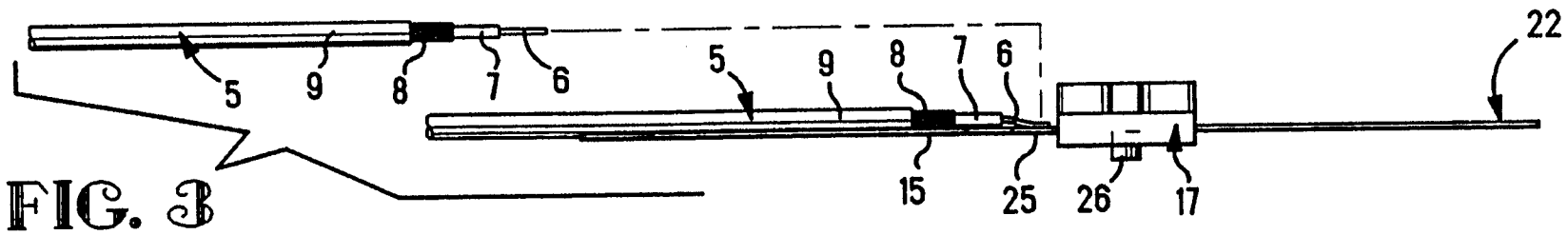
FIG. 3 is a side view of the portion of the connector shown in FIG. 2.

With more particular reference to FIGS. 1, 2 and 3, each electrical cable 5, particularly, a coaxial cable, comprises; a signal wire 6 concentrically encircled by a dielectric 7, in turn, concentrically encircled by a conductive shield 8 or sheath. The shield 8 is concentrically encircled by an insulative jacket 9. Multiple cables 5 are grouped or bundled together in an outer cable jacket 10, FIG. 1. The outer cable jacket 10 is trimmed away to expose the cables 5. The multiple cables 5 are flexible, and can be arranged side by side, so as to extend in one or more cable rows 11.

A flexible, double sided, flat cable 1 will have circuit traces 2 on both sides 3. A single sided, flat cable 1 will have circuit traces 2 on one side 3. The invention resides in an electrical connector 12 that will connect and disconnect the cables 5 to the circuit traces 2 on both sides 3 of a double sided, flat cable 1. The circuit traces 2 can be signal traces side by side, or signal traces alternating with ground traces at a reference electrical potential. Alternatively, to achieve impedance control, the signal traces on each side can be directly opposite a ground trace on an opposite side, while signal traces alternate with ground traces on each of the two sides of a flat cable.

Figure 6:
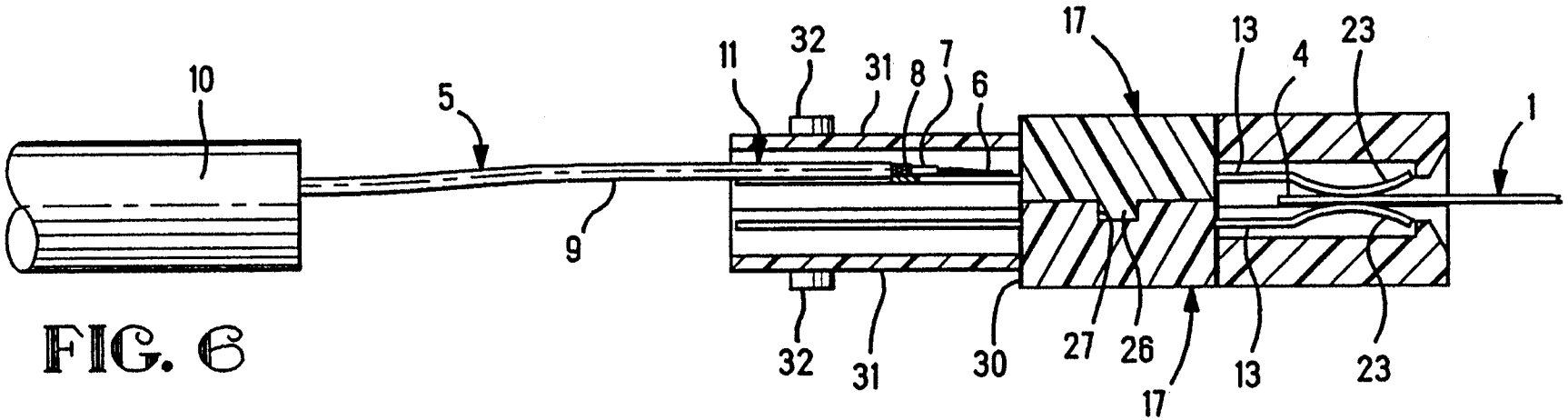
FIG. 6 is a view similar to FIG. 6 of another electrical connector.

The invention reside further in an electrical connector 12 that will connect and disconnect one row of cables 5 to the circuit traces 2 on one side 3 of a single sided, flat cable 1, FIG. 6. The single sided, flat cable may have circuit traces 2 on one side and a conductive ground plane on an opposite side. A connector according to the invention is constructed with a row of signal contacts for connection to signal traces on one side of a flat cable. A second row of signal contacts are for connection to signal traces on another side of a two sided, flat cable. There are ground contacts in the same row with the signal contacts that will connect to ground traces that are with the signal traces on the same side of the flat cable. In the same contact row, the signal contacts can alternate with the ground contacts to connect with respective signal traces and ground traces that alternate with one another on the same side of a flat cable. An entire row of contacts can be used to connect with a ground plane on one side of a flat cable.

With reference to FIGS. 1, 2, 3 and 5, one embodiment of an electrical connector 12 is constructed for connecting and disconnecting two rows 11 of coaxial cables 5 to conductor traces 2 on both sides 3 of a flat cable 1, wherein the connector 12 connects to an edge 4 of one of the double sided, flat cables 1. The connector 12 comprises, multiple electrical signal contacts 13 extending in two contact rows 14, a ground bus 15 corresponding to each of the cable rows 11 being connected to conductive shields 8 of the electrical cables 5 in the same cable row 11, at least one electrical ground contact 16 on each ground bus 15 extending in one of the contact rows 14, and insulating contact holders 17 each holding each available ground contact 16 and the signal contacts 13 in the same contact row 14 apart from one another.

As shown in FIGS. 1, 2 and 3, each of two ground contacts 16 extends forwardly from the same ground bus 15 and are at opposite ends of the same contact row 14, together with the signal contacts 13 in the same contact row 14. At least one available ground contact 16 is provided in each contact row 14, although the Figures illustrate two ground contacts 16 in each row 14. Elongated grounding tails 18 extend rearward from the ground bus 15. The grounding tails 18 are spaced apart to straddle the cables 5 arranged in the same cable row 11.

With reference to FIGS. 1 and 4, a removable ground plate 19 is connected to rear ends 20 of the grounding tails 18. The ground plate 19 is adapted to be disconnected and removed from the grounding tails 18 by fracturing along score lines 21, FIG. 2, indented in the rear ends 20 of the grounding tails 18 where they join removably to the removable ground plate 19. A space separates the ground plate 19 from the ground bus 15.

The ground bus 15, and the signal contacts 13 and each available ground contact 16 of the same contact row 14, are coplanar, and are manufactured by stamping and forming them from a flat sheet of metal to form a planar lead frame 22, FIG. 2, of unitary construction. Further details of a lead frame 22 are disclosed, for example,in U.S. Pat. No. 4,875,877. Curved contact portions 23 of the contacts 13, 16 in respective contact rows 14 are spaced apart on pitch spacings the same as the pitch spacings of the conductor traces 2 on respective, opposite sides 3 of a flexible flat cable 1. In FIGS. 2 and 3, the flat contacts 13, 16 are to be formed with the curved contact portions 23 after the holder 17 is applied. However, the curved contact portions 23 alternatively are formed on the contacts 13, 16 prior to application of the holder 17. After application of the holder 17, the contacts 13, 16 are separated from the remainder of the lead frame 22 that is discarded.

The contact holder 17 is applied to each available ground contact 16 and the signal contacts 13 in the same contact row 14. The holder 17 is injection molded directly with the contacts 13, 16, or is a separate part assembled on the contacts 13, 16. The holder 17 holds each available ground contact 16 and the signal contacts 13 on a pitch spacing corresponding to the pitch spacing of the conductor traces 2 on one side 3 of the flat cable 1.

With reference to FIGS. 1, 2 and 3, wire connecting portions 25 of the signal contacts 13 in the same contact row 14 are impinged by the signal wires 6 of the same cable row 11, and are connected, by solder joints or weld joints, to the signal wires 6 of the electrical cables 5 in the same cable row 11. The wire connecting portions 25 of the signal contacts 13 are spaced apart on a pitch spacing the same as the pitch spacing of the signal wires 6 of the cables 5 in the same cable row 11.

Figure 5:
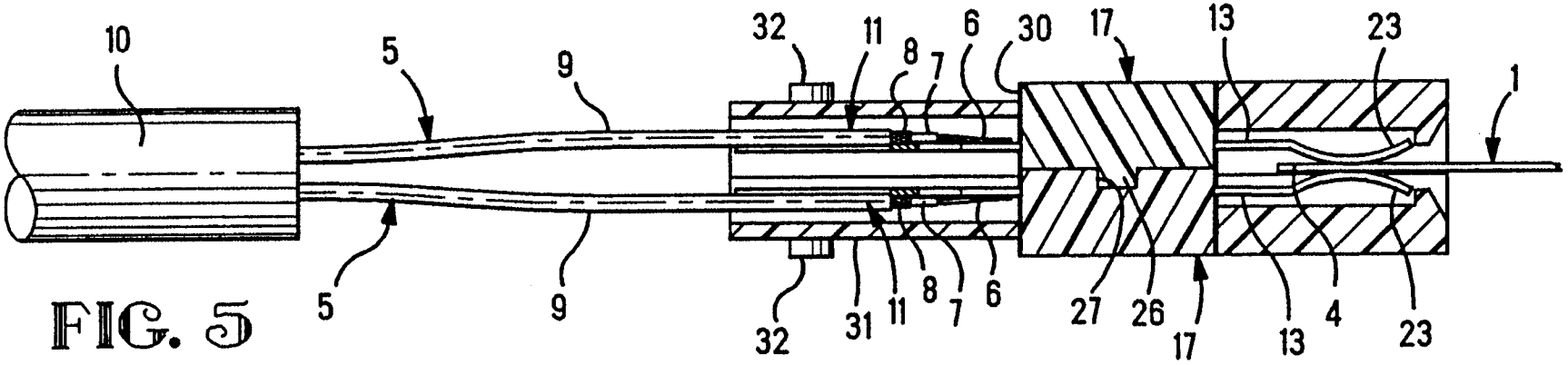
FIG. 5 is a view similar to FIG. 4 of another electrical connector.

With reference to FIGS. 1 and 5, two of the holders 24 are connected together to oppose the contacts 13, 16 of one contact row 14 with the contacts 13, 16 of the other second row 14, the opposed contacts 13, 16 of the two rows 14 being adapted to clamp a flexible flat cable 1 on the edge 4. The holders 24 interlock, with one projecting knob 26 and a recess 27 on one of the holders 24 interlocking with a recess 27 and a projecting knob 26 of the other of the holders 24. The knob 26 and recess 27 are unitary with the respective holder 24.

The curved contact portions 23 in one contact row 11 curve away from the contact portions 23 in the other contact row 11, to define a tapering, funnel entry for the edge 4 of the flat cable 1. The contact portions 23 of the two, opposed contact rows 11 ride up the edge 4 of the flat cable 1 and frictionally connect with respective conductor traces 2 on the opposite sides 3 of the flat cable 1, when the contacts 13, 16 of the two contact rows 11 clamp the flat cable 1. Clamping pressure is applied by the contacts 13, 16, which contacts 13, 16 are spring resilient.

Insulating cover plates 28 attach to respective insulating holders 24. The contacts 13, 16 and the ground bus 17 and front portions of the cables 5 are between the cover plates 28. Enlarged, irregular shaped, sockets 29 through each cover plate 28 interlock with interfitting, projecting pins 30 on respective holders 24. The pins 30 can be secured to the cover plates 28 by adhesive or by heat fusing them to the cover plates 28.

According to another embodiment of the invention, FIG. 4, pertains to one or more shielded connectors 12. For each shielded connector 12, the ground plate 19 is removed from the grounding tails 18, and is mounted on an exterior surface 31 of one of the cover plates 28 to provide an electrical, conductive shield on the exterior surface 31. Projecting pegs 32 are spaced apart and project from each cover plate 19. Openings 33 in each ground plate 19 interlock with the pegs 32. The ground plates 19 are secured to the pegs 32 by adhesive or by forming an enlarged, flattened head on the pins, for example, by the application of heat and force. The grounding tails 18 are bendable portions of each said ground bus 17 that project from between the cover plates 28. As shown in FIG. 4, the grounding tails 18 are bent to curve, and to extend toward, and impinge against, the conductive shield on the exterior surface 31, to which they are connected by solder joints or by weld joints. Thereby, each ground bus 17 is connected conductively by the grounding tails 18 with the shield on the cover plate 28. When two shielded connectors 12 are stacked together, the grounding tails 18 on each ground bus 17 can extend to the same cover plate 28 on one of the connectors 12.

According to another embodiment of the invention, FIG. 5, the connector 12 is unshielded. To construct this other embodiment of the connector 12, the ground plate 19 is removed, from the associated ground bus 15 by severing along the score lines 21. The ground plate 19 is discarded. The grounding tails 18 also can be removed and discarded. The ground bus 17 remains connected to the conductive sheaths 8 of the cables 5 in the same cable row 11, and remains between the cover plates 28. Multiple unshielded connectors 12 can be stacked together when needed, similarly as the shielded connectors 12 shown in FIG. 4.

When the flat cable 1 has conductor traces 2 on one side 3 only, the cable 1 is a one sided, flat cable. The coaxial cables 5 in only one cable row 11 are required for connection with the conductor traces 2 on one side 3 of the one sided, flat cable. The connector 12, according to another embodiment of the invention, FIG. 6, is adapted with two contact rows 14 of opposed contacts 13, 16 to clamp a one sided, flat cable 1. The insulative holders 24 of the two contact rows 14 are assembled together. Cables 5 in one cable row 11 only are connected to the contacts 13, 16 of one contact row 14 only. No cables 5 are connected to the contacts 13, 16 in the second contact row 14. The contacts 13, 16 of the second contact row 14 are present to oppose the contacts 13, 16 in the first contact row 14, and to clamp the one sided, flat cable 1 between the rows 14 of opposed contacts 13, 16. The contacts 13, 16 to which the cables 5 are connected frictionally engage and connect with the conductor traces 2 on the one sided, flat cable 1.

According to an advantage of the invention, coaxial cables 5 are arranged in a row 11, and are in-line with a contact row 14 of electrical contacts 13, 16, meaning that the cables 5 are aligned along their axes with a row 14 of electrical contacts 13, 16. The in-line, row construction of the cables 5 and the contacts 13, 16 provide the electrical connector 12 with a flat construction. According to another advantage of the invention, two rows 14 of contacts 13, 16 clamp a flexible, flat cable 1, wherein each row 14 of contacts 13, 16 can connect with conductor traces 2 on the flat cable 1, and can connect with a row 11 of coaxial cables 5.

We claim:

1. An electrical connector comprising:

multiple electrical cables in two cable rows, multiple electrical signal contacts extending in two contact rows, wire connecting portions of the signal contacts in the same contact row being connected to signal wires of the electrical cables in the same cable row, a ground bus corresponding to each of the cable rows being connected to conductive shields Of the electrical cables in the same cable row, at least one electrical ground contact of each ground bus extending in one of the contact rows, insulating holders each holding the ground and signal contacts in the same contact row apart from one another, the insulating holders being connected together to oppose the contacts of one row with the contacts of the other row, the opposed contacts being adapted to clamp a flexible flat cable, contact portions on the ground and signal contacts of the two contact rows frictionally connect with respective conductor traces on opposite sides of a flat cable when the ground and signal contacts of the two contact rows clamp the flat cable, the insulating holders attach to each other, insulating cover plates adapted to attach to respective insulating holders the contacts being between the cover plates, a conductive shield on at least one of the cover plates, bendable portions of each said ground bus projecting from between the cover plates and being bent to impinge against the conductive shield, and a conductive grounding plate removable from the bendable portions of at least one said ground bus, and the grounding plate attaches to one of the cover plates and connects with the conductive shield.

2. An electrical connector comprising:

multiple electrical cables in at least one cable row, multiple electrical signal contacts extending in a first contact row, wire connecting portions of the signal contacts in the first contact row being connected to signal wires of the electrical cables in the same cable row, a ground bus corresponding to the cable row being connected to conductive shields of the electrical cables in the same cable row, at least one electrical ground contact of the ground bus extending in the first contact row, a first insulating holder holding the ground and signal contacts in the first contact row apart from one another, additional contacts opposing respective ground contacts and signal contacts, a second holder holding the additional contacts in a second contact row, the insulating holders attaching to each other to oppose the contacts of one row with the contacts of the other row, the opposed contacts being adapted to clamp a flexible flat cable, contact portions on the ground and signal contacts of the first contact row frictionally connecting with respective conductor traces on one side of a flexible, flat cable when the opposed contacts of the two contact rows clamp the flexible, flat cable, insulating cover plates attaching to respective insulating holders, the contacts being between the cover plates, a conductive shield on at least one of the cover plates, bendable portions of each said ground bus projecting from between the cover plates and being bent to impinge against the conductive shield, and a conductive grounding plate removable from the bendable portions of at least one said ground bus, and the grounding plate being adapted to attach to one of the cover plates and connects with the conductive shield.

3. An electrical connector comprising: two rows of opposed electrical contacts for clamping a flat cable, at least one row of coaxial cables having signal wires connected to signal contacts solely in one contact row, conductive shields of the cables connected to a ground bus, in turn, connected to at least one ground contact solely in said one contact row, both rows of contacts being held by insulative holders, the contacts of said one contact row opposing the contacts of the other row and clamping a flat cable between the rows, all the contacts of said one contact row being connected to the conductors of each cable extending solely to one side of a flat cable, and all the contacts of said one contact row frictionally engaging conductor traces on said one side of the flat cable.

4. An electrical connector as recited in claim 3, and further comprising: additional electrical cables having signal conductors connected to the electrical contacts in a second of said contact rows, and contact portions of the contacts in respective contact rows being spaced apart on pitch spacings the same as conductor traces on respective, opposite sides of a flat cable.

5. An electrical connector comprising:

multiple signal contacts in two contact rows, electrical cables in two cable rows, wire connecting portions of the contacts in each of the contact rows connected to respective signal wires of the electrical cables in one of the cable rows, at least one ground contact extending in each contact row, an insulating holder holding said at least one ground contact and the signal contacts apart from one another in the same contact row, a ground bus connected to the ground contact and to conductive shields of the cables in the same cable row, the ground and signal contacts in the two contact rows are adapted to clamp a flat cable, all conductors of the same cable and the contacts connected to the same cable extend solely to one side of a circuit, and contact portions of the contacts in the two contact rows frictionally connect with conductor traces on opposite sides of a flat cable when the contacts in the two contact rows clamp the flat cable.

6. An electrical connector as recited in claim 5, and further comprising: insulating cover plates attached to respective insulating holders, and the contacts being between the cover plates.

7. An electrical connector as recited in claim 5, wherein the insulative holders attach to each other, insulating cover plates attach to respective insulating holders, the contacts are between the cover plates, a conductive shield is on at least one of the cover plates, and a bendable portion of each said ground bus projects from between the cover plates and is bent to impinge against the conductive shield.

8. An electrical connector as recited in claim 7 wherein, the bendable portion overlaps the same one of the cover plates to impinge against the conductive shield.

9. An electrical connector as recited in claim 7 wherein, a conductive grounding plate is removable from the bendable portion of one said ground bus, and the grounding plate attaches to one of the cover plates and connects with the conductive shield.

* * * * *